US006101776A

United States Patent [19]

Conley

[11] Patent Number: 6,101,776

[45] Date of Patent: Aug. 15, 2000

[54] SUB-FLOOR PANEL SYSTEM

[75] Inventor: Earl G. Conley, Broken Arrow, Okla.

[73] Assignee: Cerad Industries, Inc., Sand Springs, Okla.

[21] Appl. No.: 09/237,216

[22] Filed: Jan. 25, 1999

[51] Int. Cl.[7] ..... E04B 1/16

[52] U.S. Cl. ..... 52/379; 52/355; 52/747.11; 52/447.12; 52/509; 219/213

[58] Field of Search ..... 52/309.12, 344, 52/347, 355, 378, 379, 391, 392, 418, 480, 582.1, 609, 747.1, 747.11, 747.12, 509; 219/213

[56] References Cited

U.S. PATENT DOCUMENTS

| | | | |
|---|---|---|---|
| 543,582 | 7/1895 | Meyenberg . | |
| 1,101,786 | 6/1914 | Craine . | |
| 1,579,016 | 3/1926 | Marks | 52/418 X |
| 1,828,193 | 10/1931 | Levin . | |
| 1,857,534 | 5/1932 | Ellis | 52/344 |
| 1,896,325 | 2/1933 | Noonan | 52/509 X |
| 1,954,611 | 4/1934 | Bennett | 52/509 |
| 2,201,129 | 5/1940 | Weiland | 52/509 |
| 2,231,780 | 2/1941 | Swenson | 52/747.11 X |
| 2,735,523 | 2/1956 | Leyerle et al. | 52/509 |
| 2,904,990 | 9/1959 | Emmerling | 52/392 |
| 3,846,945 | 11/1974 | Roby . | |
| 3,909,996 | 10/1975 | Ettlinger, Jr. et al. . | |
| 4,359,848 | 11/1982 | Haeussler | 52/378 X |
| 4,519,173 | 5/1985 | Roberts | 52/509 X |
| 4,597,235 | 7/1986 | Olsen | 52/509 |
| 4,638,618 | 1/1987 | Iesaka et al. | 52/509 |
| 4,841,703 | 6/1989 | Grimaud | 52/378 X |
| 5,461,213 | 10/1995 | Rodin | 219/213 |
| 5,908,573 | 6/1999 | Chiles et al. | 219/213 X |

*Primary Examiner*—Richard Chilcot
*Attorney, Agent, or Firm*—Fellers, Snider, Blankenship, Bailey & Tippens, P.C.

[57] ABSTRACT

A sub-floor system for installing a monolithic slab using precast cementitious sub-floor panel sections. The panel sections are placed over the spaced-apart, parallel joists of the floor frame. Each panel has beveled edges which abut the beveled edges of its adjacent panels. The beveled edges between adjacent panel sections thus define a V-shaped seam area. Importantly, the panels are dimensioned such that the beveled panel edges running parallel to the joists are substantially on center over the joists. This allows for the insertion of anchors through the seam areas and into the joists. The anchors are only partially implanted into the joists so that the anchor heads project upwardly between the panel sections. The seam areas are then filled with an adhesive filler material, resulting in a high strength monolithic slab.

17 Claims, 3 Drawing Sheets

SUB-FLOOR PANEL SYSTEM

BACKGROUND OF THE INVENTION

1. Field of the Invention

This invention relates generally to the construction of concrete flooring, and, more specifically, to the use of precast cementitious panels to form a monolithic slab sub-floor.

2. Background

Building codes and engineering specifications often require the use of concrete slab flooring. The concrete sub-floor is generally poured into place to form a monolithic slab.

Poured concrete floors necessitate the use of placement equipment such as mixers and pumps manned by trained personnel. Lack of proper equipment and unavailability of wet concrete placement labor often plagues small construction projects. Weather and cure time also inject uncertainty and delay into construction timetables. Construction crews must wait until the poured concrete floor is completely cured before resuming work in the structure.

Thus, there exists a need for a better way to install monolithic concrete slab flooring. It is the object of the present invention to fill this need.

SUMMARY OF THE INVENTION

The desired objective is achieved through a novel method for installing a monolithic slab using precast sub-floor panel sections. The panel sections are placed over the spaced-apart, parallel joists of the floor frame. Each panel has a beveled peripheral edge which abuts the beveled edges of its adjacent panels. The beveled edges between adjacent panel sections thus define a V-shaped seam area. Importantly, the panels are dimensioned such that the beveled panel edges running parallel to the joists are substantially on center over the joists, as are the corners of the panels. This allows for the insertion of anchors through the seam areas and into the joists. The anchors are only partially implanted into the joists so that the anchor heads project upwardly between the panel sections. The seam areas are then filled with an adhesive filler material, resulting in a high strength monolithic slab.

In a preferred embodiment, the panel sections are of two complementary sizes selected to provide, upon installation, a staggered joint system. A rectangular first panel has a longest dimension which is twice the distance on center between the joists. The second panel is also rectangular and has a longest dimension which is equal to the distance on center between the joists. In the most preferred embodiment, which is directed to joists having a typical 16" on center spread, the first panel measures 16" by 32" while the second panel is a 16" by 16" square. The first and second panels are similarly dimensioned in other respects.

In the preferred embodiment, the panel sections are easily positioned in the appropriate alignment by alternating rows wherein the first row contains substantially all first panels and the second row begins with one of the second panels followed by first panels. In this manner a seam area, and consequently an anchoring area, is provided over every other joist on each row of panel sections.

In accordance with another aspect of the invention, each corner of the first and second panels is bevel cut. As a consequence, upon installation of the panel sections the juxtaposed corners of adjacent panels form an anchor seating area over the joists. The seating area comprises a clear space through which an anchor may be inserted into the joist.

In accordance with other aspects of the invention, each panel section may be provided with an embedded layer of electrically conductive wire for producing a radiative heat throughout the slab structure. In a like manner, the strength of the panel sections may be augmented by the inclusion of a layer of wire mesh reinforcement. A layer of foam insulation, if applied to the underside of the panel sections, confines the heat of a radiative panel and directs it upward while also acting to dampen sound.

A better understanding of the present invention, its several aspects, and its objects and advantages will become apparent to those skilled in the art from the following detailed description, taken in conjunction with the attached drawings, wherein there is shown and described the preferred embodiment of the invention, simply by way of illustration of the best mode contemplated for carrying out the invention.

DETAILED DESCRIPTION OF THE PREFERRED EMBODIMENT

Figure 1:
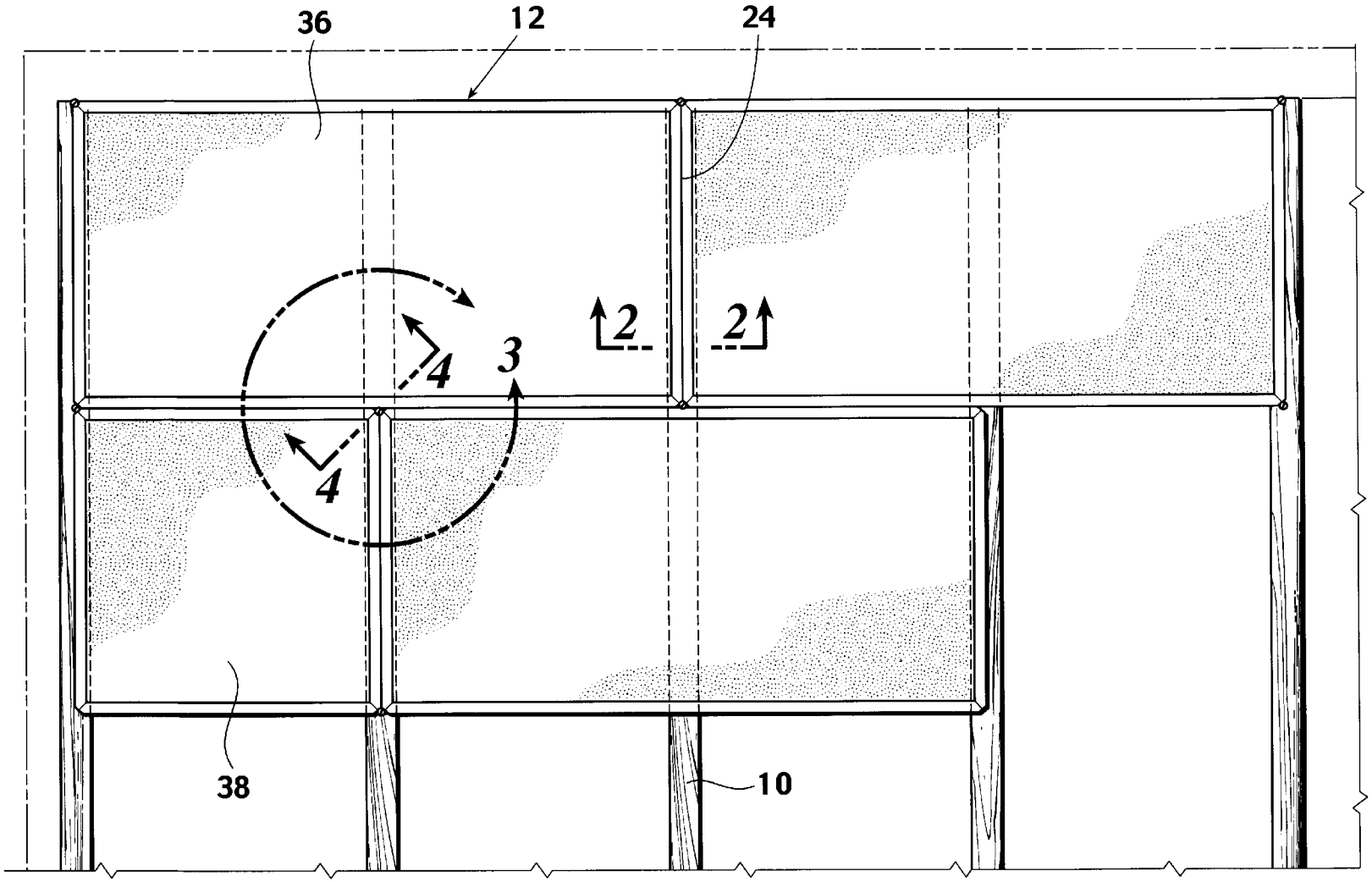
FIG. 1 is a top plan view demonstrating details of the preferred embodiment of the invention.

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Reference is now made to the drawings, wherein like reference numerals designate identical or corresponding parts throughout the several views.

The environment of the invention includes the spaced-apart, parallel joists 10, which form a typical floor frame such as might be present in a single or multi-story structure. Though the invention is described hereunder in connection with this environment, it is contemplated that the application of the invention may well further extend to wall or ceiling structures.

Figure 2:
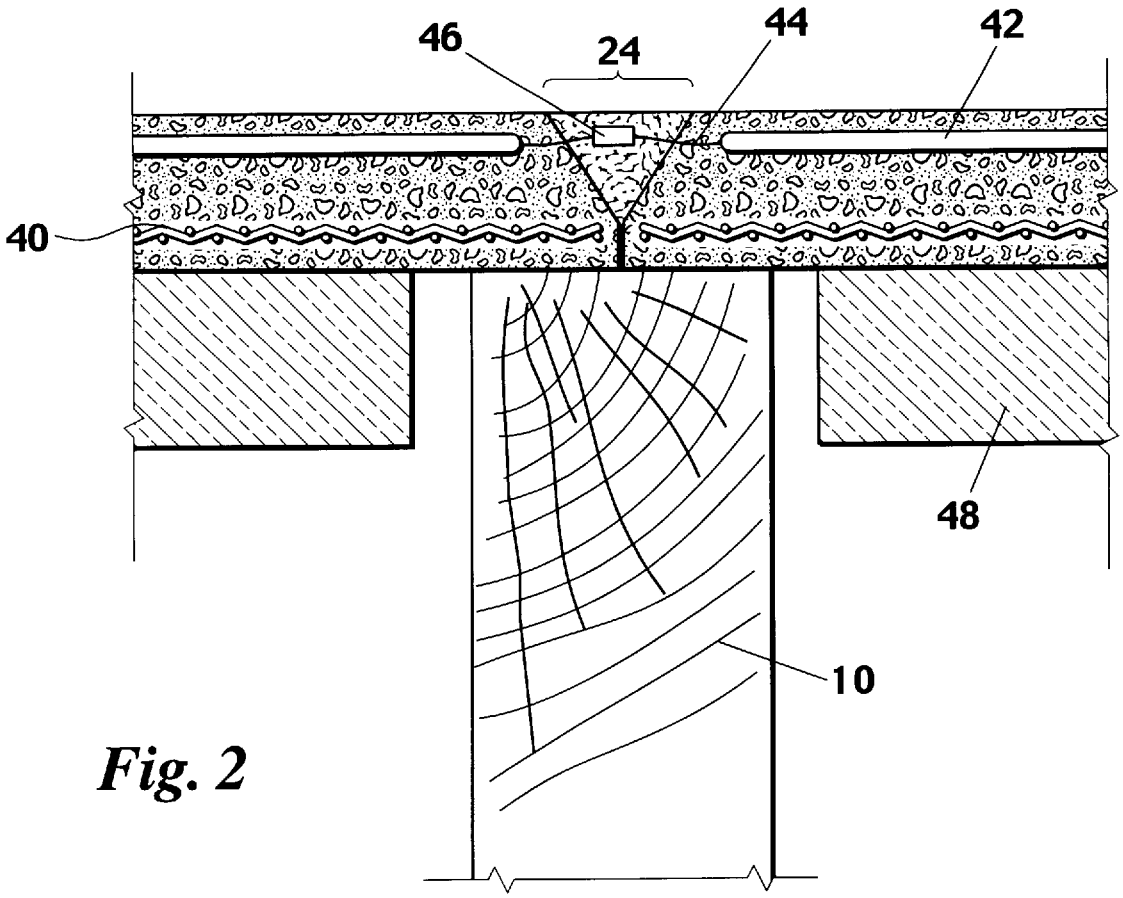
FIG. 2 is a cross sectional view taken along line 2—2 of FIG. 1.
Figure 5:
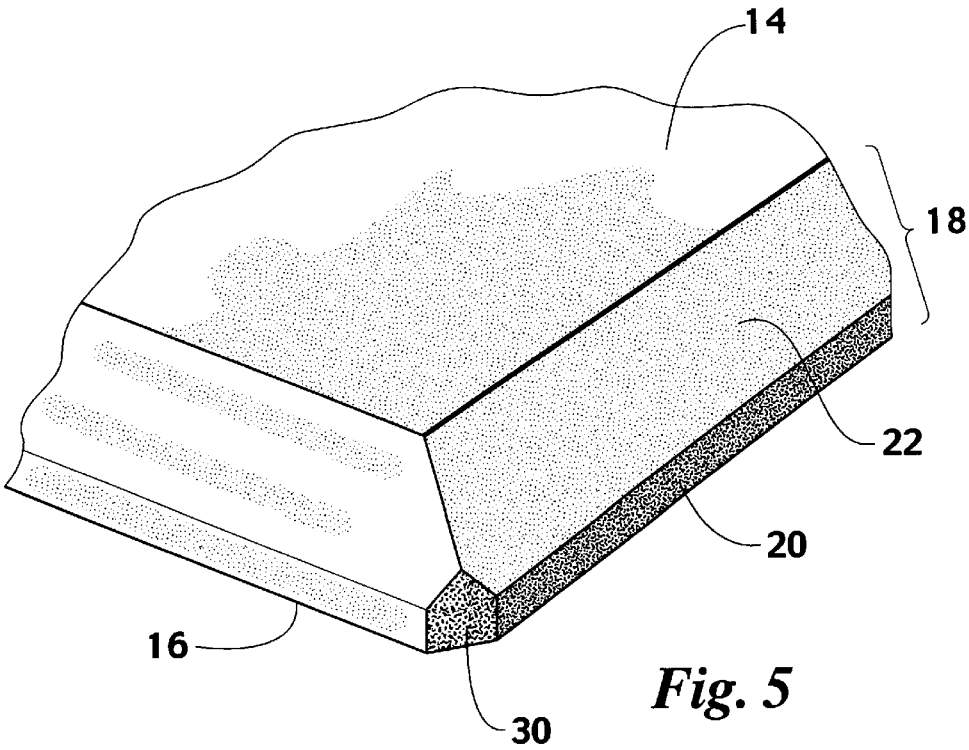
FIG. 5 is an enlarged view of the corner of the preferred embodiment.

The inventive panel system utilizes precast polygonal panel sections of the type generally indicated by reference number 12. Each panel section 12 is preferably rectangular in shape, and, as best shown in FIG. 5, each has an upper tread surface 14, an underside 16, and a peripheral edge 18. Preferably, the edge 18 of the panel section 12 is beveled. Most preferably, the edge 18 is composed of two surfaces—upright surface 20 and beveled surface 22. When the panel sections 12 are properly placed adjacent to each other, as hereinafter described, the upright surface edges 20 of adjacent panel sections 12 abut, and, above the abutting upright surface edges 20, there is created a V-shaped seam area 24 (FIG. 2).

Figure 3:
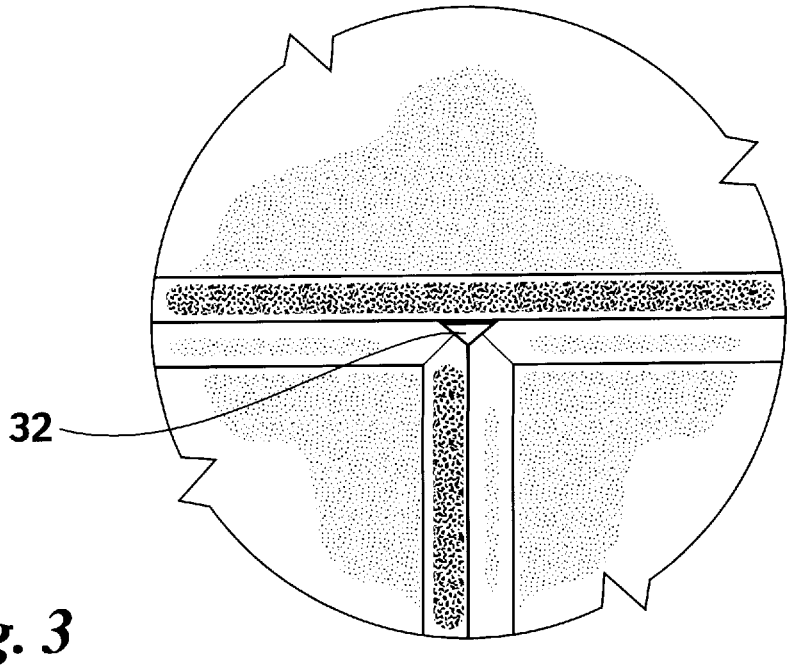
FIG. 3 is an enlarged top plan view of the area of FIG. 1 circumscribed by line 3.
Figure 4:
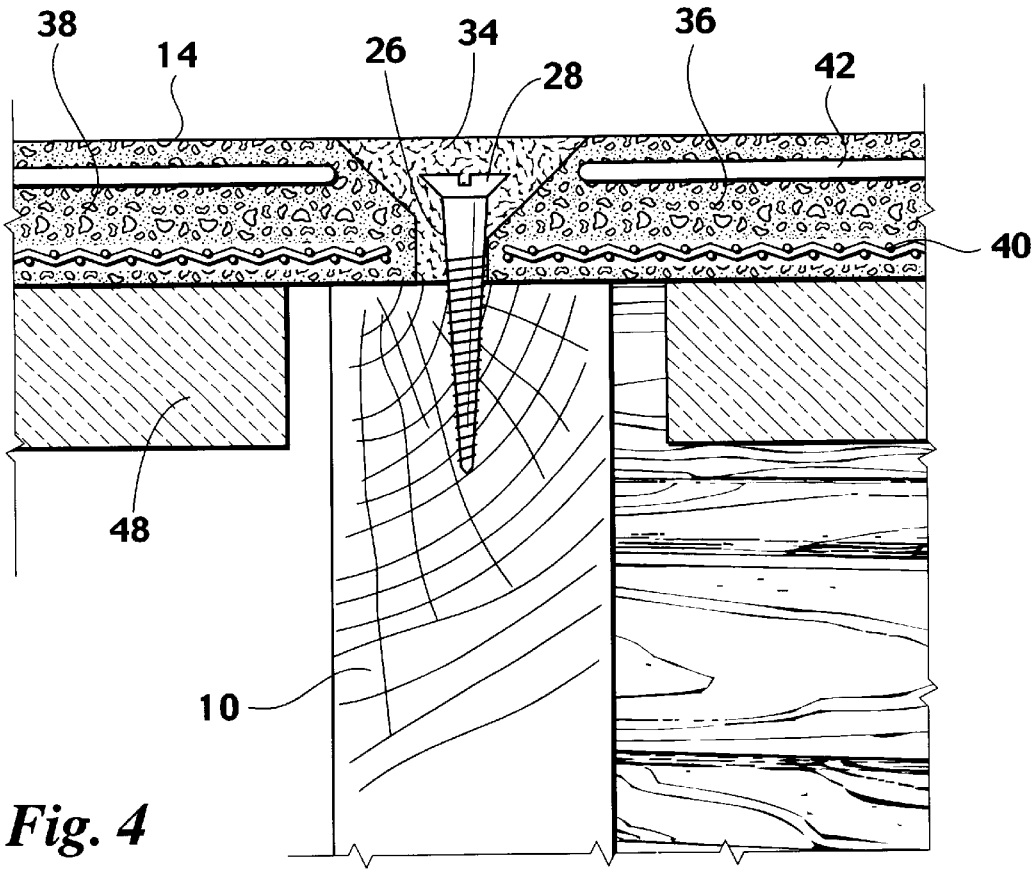
FIG. 4 is a cross sectional view taken along line 4—4 of FIG. 1.

The panel sections are dimensioned and precast to take into account the distance between the joists 10 so that the seam areas 24 running parallel to the joists 10 are substantially on center over the joists 10. Having the seam areas 24 over the joists 10 strengthens the floor assembly and makes it easy to insert anchors 26 at selected intervals between adjacent panel sections and into the joists 10. The anchors 26, as best illustrated in FIG. 4, are only partially inserted into the joists 10 so that the anchor heads 28 project above the joists 10 but below the tread surface 14 of the panel sections 12. Most preferably, the anchors 26 are inserted at each corner 30 of the panel sections 12 in an anchor seating area 32 (FIG. 3) created between the juxtaposed corners of adjacent panel sections. To provide the anchor seating areas 32, each corner 30 of the panel sections 12 is itself bevel cut (FIG. 5) through the upright surface 20 and slightly into the beveled surface 22 of edge 18. As is shown in FIG. 1, every corner 30 of each panel section 12 lies substantially on center over a joist 10. With the present system, each panel section 12 is stabilized in its appropriate position over the joists 10 and maximum floor strength is achieved.

The seam areas 24 between the joists 10 are filled with a fast setting adhesive filler material 34, which bonds to each panel section 12 and to anchor 26, to form the desired monolithic slab.

Utilizing the inventive panels, a monolithic slab sub-floor may be quickly installed under any weather conditions and can be applied by any semi-skilled worker. As opposed to standard poured concrete flooring, a sub-floor created with the inventive precast panels requires little cure time. Construction crews can continue work on finishing a structure within as little as an hour after the application of the flooring system.

For further illustration reference is made to the typical case of joists spaced apart 16" on center. In a preferred embodiment of the invention, the panel sections 12 are of two sizes. A rectangular first panel 36 has a longest dimension which is twice the distance between the center of the joists 10, i.e., 32". The second panel 38 is half the length of the first panel, i.e., 16". The panels are otherwise similarly dimensioned, having a preferred 16" width. The most preferred panel has a nominal thickness of about 1". The sub-floor shown in FIG. 1 is thus easily installed by alternating rows of said panels, wherein one of the two alternating rows consists of all first panels 36 while the other of the rows begins with a second panel 38 and follows with first panels 36. Maximum floor strength is achieved with this construction method through the staggering of the seam areas 24 to provide in essence a staggered joint system. It will be recognized that the distance between the joists 10 is not critical. For further example, joists 10 might be 12" on center whereupon the preferred embodiment would include a first panel measuring 12" by 24" and a second panel measuring 12" by 12" to achieve the desired staggered joint arrangement.

Although the particular composition of the panel sections 12 does not form part of the instant invention, it is preferred, although not required, that the panel sections be made of a cementitious material. Again, using a 16" by 32" panel section as an example, a satisfactory cementitious formulation consists of a well mixed combination of the following ingredients:

Example Formulation 7 lbs. Portland cement 3 lbs. fly ash 10 lbs. medium sand 2 lbs. perlite 5 lbs. water After mixing, the ingredients may be poured into a mold, such as a mold formed of polyurethane rubber, and cured to obtain a single first panel section 36. The formulation of the cementitious panel sections may be adjusted by varying the constituents of the composition and ratios of ingredients to obtain panels having the highest flexural and impact strengths possible with concrete products. It is contemplated, however, that the panel sections 12 may be made in other ways or with other materials as are well known in the art.

An example formulation of a fast setting adhesive cement compatible with the present invention is as follows:

Example Formulation 100 parts Portland cement 1 part calcium chloride 50 parts fly ash 100 parts fine sand 20 parts latex resin compound, preferably an acrylic copolymer water to disperse To further strengthen a panel section 12, and as shown in FIGS. 2 and 4, a layer of wire mesh reinforcement 40 may be embedded in the panel section 12 during the above-described molding process. With respect to the aforementioned illustrative panel, it is preferred to include a layer of welded #12 steel wire having 4" by 4" squares.

In accordance with another aspect of the invention, an embedded layer of electrically conductive material 42 (FIGS. 2 and 4), such as nichrome high electrical resistance wire, is molded into the top portion of the cementitious panel section 12 to produce a heat capable sub-floor panel. As electric current is applied, heat is produced which radiates throughout the cementitious mass. In effect, the sub-floor becomes a radiator which may replace or augment conventional air circulated heat. Each panel section 12 has an electrical lead 44. To conduct the applied current throughout the entirety of the installed monolithic slab, the respective leads 44 of adjacent panel sections 12 are connected by coupler 46 to form an electrical array. The heat produced may be confined and directed upwards through the use of a layer of insulative material 48 applied to the underside 16 of the panel sections 12. The insulative material 48 further serves as a sound barrier, such as might be advantageous between floors of a multi-story structure.

From the foregoing, it is evident that the present invention provides a ready substitute for poured-in-place concrete flooring. Raw material costs are moderate and production costs are calculable based upon daily mechanical output, making the panel sections a "shelf storage" item which can be inventoried for rapid shipment.

While the invention has been described with a certain degree of particularity, it is understood that the invention is not limited to the embodiment(s) set for herein for purposes of exemplification, but is to be limited only by the scope of the attached claim or claims, including the full range of equivalency to which each element thereof is entitled.

What is claimed is:

1. A method for installing a monolithic slab over a plurality of spaced-apart, parallel joists, comprising the steps of:

(a) covering the joists with a plurality of precast panel sections, each of the panel sections having a plurality of beveled side edges and a plurality of beveled corners, wherein the panel sections are positioned adjacent to each other and are dimensioned such that adjacent beveled side edges of adjacent panel sections form V-shaped seams, at least a first portion of the V-shaped seams run substantially parallel to and are positioned over the joists, and adjacent beveled corners of the adjacent panel sections form open seating areas over the joists;

(b) inserting anchors into the open seating areas such that a first portion of the anchor is secured in a joist and a second portion of the anchor extends into the open seating area; and (c) filling the V-shaped seams and the open seating areas with an adhesive filler material to form a monolithic slab.

2. The method according to claim 1, wherein the precast panel sections are of two panel sizes comprising a rectangular first panel having a longest dimension which is twice the distance on center between the joists and a rectangular second panel having a longest dimension which is equal to the distance on center between the joists, the first and second panels being similarly dimensioned in other respects, and wherein the covering step includes placing the panel sections over the joists in alternating rows wherein one row contains substantially all first panels and the other row begins with one of the second panels.

3. The method according to claim 2, wherein the first panel measures 16"×32".

4. The method according to claim 1, wherein the panel sections each include an embedded layer of wire mesh reinforcement.

5. The method according to claim 1, wherein:

the panel sections each include an embedded heat conductor molded into the panel section;

the panel sections include electrical leads extending from the embedded heat conductors to the exteriors of panel sections; and the method further comprises the step of coupling the electrical leads of adjacent panel sections to form an electrical array.

6. The method according to claim 1, wherein the panel sections each include an underlying layer of insulative material.

7. The method according to claim 1, wherein:

each of the panel sections has an upper surface;

the panel sections are positioned in step (a) such that the upper surfaces of the panel sections are substantially coplanar; and the V-shaped seams and the open seating areas are filled in step (a) to a level such that the adhesive filler material is substantially even with the upper surfaces of the panel sections.

8. The method according to claim 1, wherein:

each of the beveled side edges includes an upper, angled portion and a lower, substantially vertical portion and each of the beveled corners comprises a bevel cut which extends through the lower, substantially vertical portions and partially into the upper, angled portions of the beveled side edges.

9. The method according to claim 1, wherein a second portion of the V-shaped seams do not run parallel to the joists.

10. The method according to claim 9, wherein the second portion of the V-shaped seams are substantially perpendicular to the first portion of the V-shaped seams.

11. The method according to claim 9, wherein:

each of the panel sections has an upper surface;

the panel sections are positioned in step (a) such that the upper surfaces of the panel sections are substantially coplanar; and all of the V-shaped seams and the open seating areas are filled in step (c) to a level such that the adhesive filler material is substantially even with the upper surfaces of the panel sections.

12. A panel for use in connection with the method of claim 1, comprising a rectangular section having beveled edges and beveled corners and dimensioned such that, when positioned over a plurality of joists, each beveled edge running parallel to the joists is substantially on center over one of the joists, whereby there is defined between adjacent panel sections a V-shaped seam area over the joists, and every corner of each panel section lies substantially on center over one of the joists.

13. The panel according to claim 12, wherein the panel includes an embedded layer of wire mesh reinforcement.

14. The panel according to claim 12, wherein the panel includes an underlying layer of insulative material.

15. The panel according to claim 12 further comprising:

an embedded heat conductor molded into the panel and an electrical lead extending from the embedded heat conductor to the exterior of the panel, wherein the electrical lead can be coupled with an electrical lead of an adjacent panel to form an electrical array.

16. A panel for use with other such panels placed adjacent thereto to form a monolithic slab, the panel comprising:

a precast panel section;

an embedded heat conductor molded into the panel section; and an electrical lead extending from the embedded heat conductor and projecting from the panel section such that the electrical lead can be coupled with an electrical lead of an adjacent panel to form an electrical array.

17. The panel according to claim 16, wherein the panel section is precast from a cementitious material.

* * * * *